US010295152B2

(12) United States Patent
Gouda et al.

(10) Patent No.: US 10,295,152 B2
(45) Date of Patent: May 21, 2019

(54) LED LAMP

(71) Applicant: Phoenix Electric Co., Ltd., Himeji-shi, Hyogo (JP)

(72) Inventors: Tetsuya Gouda, Himeji (JP); Kenichi Yamashita, Himeji (JP)

(73) Assignee: Phoenix Electric Co., Ltd., Hyogo (JP)

( * ) Notice: Subject to any disclaimer, the term of this patent is extended or adjusted under 35 U.S.C. 154(b) by 0 days.

(21) Appl. No.: 16/019,757

(22) Filed: Jun. 27, 2018

(65) Prior Publication Data

US 2019/0003680 A1 Jan. 3, 2019

(51) Int. Cl.

| | |
|---|---|
| ***F21V 13/00*** | (2006.01) |
| ***F21V 9/00*** | (2018.01) |
| ***F21V 7/00*** | (2006.01) |
| ***F21V 7/04*** | (2006.01) |
| ***F21V 7/06*** | (2006.01) |
| ***F21V 9/08*** | (2018.01) |
| ***F21V 13/14*** | (2006.01) |

(Continued)

(52) U.S. Cl.

CPC ..... *F21V 9/00* (2013.01); *F21V 7/0008* (2013.01); *F21V 7/043* (2013.01); *F21V 7/06* (2013.01); *F21V 9/08* (2013.01); *F21V 11/16* (2013.01); *F21V 13/02* (2013.01); *F21V 13/08* (2013.01); *F21V 13/12* (2013.01); *F21V 13/14* (2013.01); *F21V 29/503* (2015.01); *F21V 29/504* (2015.01); *F21V 29/70* (2015.01); *F21Y 2103/00* (2013.01); *F21Y 2115/10* (2016.08)

(58) Field of Classification Search

CPC ..... F21S 41/14; F21S 41/16; F21S 41/147

See application file for complete search history.

(56) References Cited

U.S. PATENT DOCUMENTS

| | | |
|---|---|---|
| 4,829,407 A | 5/1989 | Bushell et al. |
| 8,770,800 B1 | 7/2014 | Yriberri et al. |

(Continued)

FOREIGN PATENT DOCUMENTS

| | | |
|---|---|---|
| CN | 205208205 U | 5/2016 |
| JP | 53-43885 | 9/1952 |

(Continued)

OTHER PUBLICATIONS

Office Action dated Aug. 17, 2017 for Japanese Patent Application No. 2017-126851 and English translation.

(Continued)

*Primary Examiner* — Andrew J Coughlin

(74) *Attorney, Agent, or Firm* — Lucas & Mercanti, LLP

(57) ABSTRACT

A light emitting diode lamp is composed of a light emitting diode, a band-pass filter and a light angle adjuster. The filter has a light cutoff function to cut off a light ray with a specific wavelength. The light angle adjuster allows the light rays emitted from the diode to be incident on the filter at incident angles of less than or equal to a maximum incident angle up to which the filter is capable of exerting the light cutoff function. The light angle adjuster is a reflector. The diode is mounted to a bottom portion. The filter is mounted to an opening. On an imaginary cross section including the optical axis, an angle formed between the optical axis and a straight line is less than or equal to the maximum incident angle, the straight line connects the emission center and an edge of the opening.

7 Claims, 17 Drawing Sheets

(51) Int. Cl.

| | |
|---|---|
| ***F21V 29/504*** | (2015.01) |
| ***F21V 29/503*** | (2015.01) |
| ***F21V 29/70*** | (2015.01) |
| ***F21V 11/16*** | (2006.01) |
| ***F21V 13/02*** | (2006.01) |
| ***F21V 13/08*** | (2006.01) |
| ***F21V 13/12*** | (2006.01) |
| *F21Y 115/10* | (2016.01) |
| *F21Y 103/00* | (2016.01) |

(56) References Cited

U.S. PATENT DOCUMENTS

| | | | | |
|---|---|---|---|---|
| 2010/0141152 | A1 | 6/2010 | Meijer et al. | |
| 2011/0299270 | A1* | 12/2011 | Kojima | G02B 5/045 362/97.1 |
| 2011/0299284 | A1 | 12/2011 | Van De Ven et al. | |
| 2012/0140463 | A1 | 6/2012 | Kinzer et al. | |
| 2013/0282082 | A1 | 10/2013 | Daijo et al. | |
| 2014/0340923 | A1 | 11/2014 | Minami et al. | |
| 2015/0138799 | A1* | 5/2015 | Schwaiger | F21V 29/505 362/510 |
| 2016/0025283 | A1 | 1/2016 | Chen | |

FOREIGN PATENT DOCUMENTS

| | | | |
|---|---|---|---|
| JP | 2004087428 | A | 3/2004 |
| JP | 2008-041558 | A | 2/2008 |
| JP | 2008041558 | A | 2/2008 |
| JP | 2009500786 | A | 1/2009 |
| JP | 2012074550 | A | 4/2012 |
| JP | 2012200469 | A | 10/2012 |
| JP | 2013186095 | A | 9/2013 |
| JP | 2014164098 | A | 9/2014 |
| JP | 2016129189 | A | 7/2016 |
| WO | 2013132530 | A1 | 9/2013 |
| WO | 2017/055681 | A1 | 4/2017 |

OTHER PUBLICATIONS

Office Action dated Dec. 26, 2017 for Japanese Patent Application No. 2017-133172 and English translation.

Extended European Search Report dated Oct. 23, 2018 from European Application No. 18179529.5.

English Translation of Taiwanese Office Action dated Nov. 29, 2018 from Taiwanese Application No. 107120883.

* cited by examiner

FIG. 12
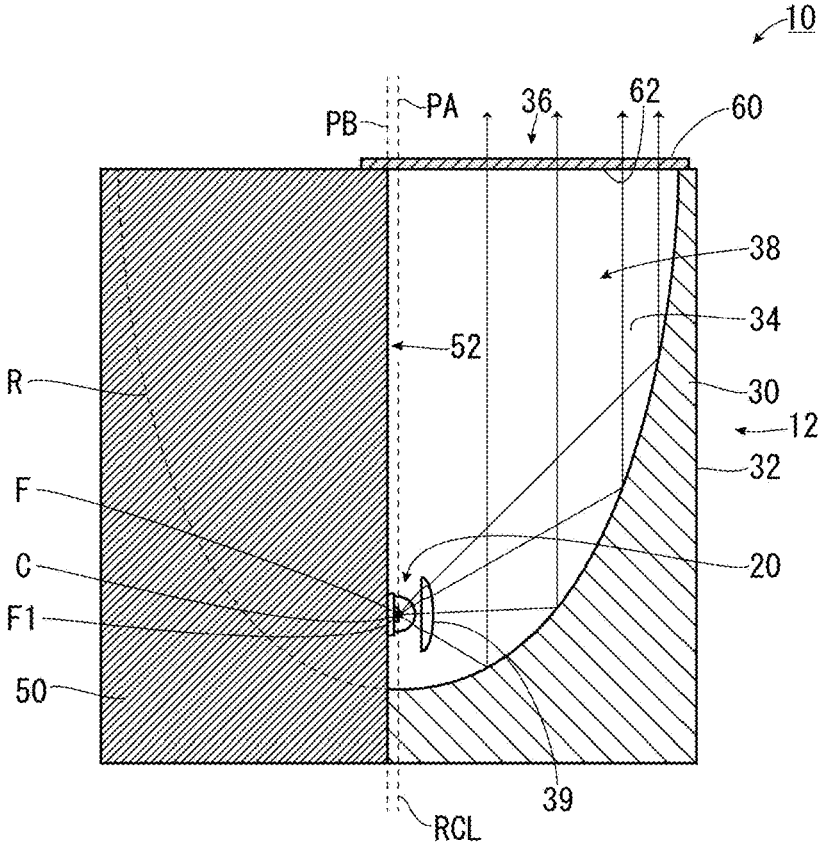
FIG.12
FIG. 13
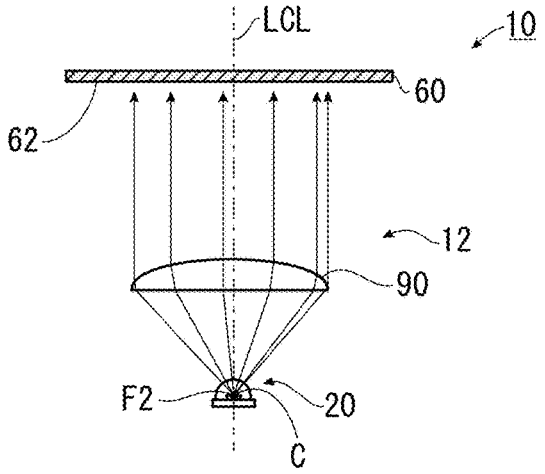
FIG.13

LED LAMP

CROSS REFERENCE TO RELATED APPLICATION

This application claims the priority of Japanese Patent Applications No. 2017-126851 filed on Jun. 29, 2017 and No. 2017-133172 filed on Jul. 6, 2017, which are incorporated by reference herein.

BACKGROUND OF THE INVENTION

Field of the Invention

The present invention relates to a light emitting diode lamp (LED lamp) that is efficiently restricted from emitting, for instance, visible light rays.

Background Art

Light emitting diodes have advantages that the power consumption thereof is lower and the life thereof is longer compared to well-known incandescent lamps (e.g., halogen lamps). With enhancement in awareness of ecology by demanders, the usage fields of the light emitting diodes have been rapidly expanding as one of the measures for energy saving. Especially, the light emitting diodes have been increasingly used as relatively compact light sources used as sensors and so forth.

For example, Japan Laid-open Patent Application Publication No. 2013-186095 discloses a technology for a light emitting diode lamp to cut off visible light rays from light rays emitted from a light emitting diode with use of a band-pass filter.

Incidentally, as to an AlGaAs infrared light emitting diode used as an infrared sensor or so forth, emission wavelength distribution is likely to be elongated to a visible light side although the wavelength of light, corresponding to the peak of the amount of light emission, reliably falls within a wavelength range of infrared light. Hence, visible light rays are also included in light rays emitted from the AlGaAs infrared light emitting diode.

When used as a sensor, a light emitting diode lamp is likely to be preferred to emit light rays in which visible light rays (red light rays) are not included so as not to make a viewer perceive whether or not the light emitting diode lamp is lit.

In general, a band-pass filter is used to cut off light rays with unnecessary wavelengths. With use of the band-pass filter, the light emitting diode lamp used as a sensor can also cut off a large part of visible light rays.

However, it was found that the band-pass filter tends to be unable to exert a light blocking (cutoff) function with respect to light rays incident on the band-pass filter at incident angles of greater than a predetermined angle (this tendency will be hereinafter referred to as "incident angle dependency" of the band-pass filter). Moreover, it was also found that this tendency is remarkable for a type of band-pass filter in which an optical thin film is disposed on the surface of a substrate. A boundary wavelength for determining whether or not light rays should be cut off is more definitely set for the band-pass filter with the optical thin film than for, e.g., a type of band-pass filter that selects light rays allowed to transmit therethrough by absorbing unnecessary light rays. Hence, there is high demand to use the band-pass filter with the optical thin film.

Furthermore, in general, "divergence angle" of light rays emitted from a light emitting diode is definitely presented in such a condition as sale of the light emitting diode. For example, when the divergence angle of light rays emitted from the light emitting diode is 10 degrees, this means that 50% of the total amount of light rays emitted from the light emitting diode form angles of less than or equal to 10 degrees together with the optical axis of the light emitting diode. In other words, the remaining 50% of the total amount of light rays form angles of greater than 10 degrees together with the optical axis of the light emitting diode. By taking this point into consideration together with the aforementioned incident angle dependency of the band-pass filter, resultant conclusion is that when a light emitting diode lamp is obtained by simply combining a light emitting diode and a band-pass filter, a large amount of light rays are supposed to be incident on the band-pass filter at incident angles of greater than the maximum incident angle, up to which the band-pass filter is capable of exerting the light cutoff function. Because of this, a drawback has frequently emerged that light rays with undesired wavelengths cannot be completely cut off in spite of using the band-pass filter.

The present invention has been developed in view of the aforementioned drawback of the well-known art. Therefore, it is a main object of the present invention to provide a light emitting diode lamp that can reduce, as much as possible, chances of emitting light rays with undesired wavelengths in use of a band-pass filter having specific incident angle dependency.

SUMMARY OF THE INVENTION

According to an aspect of the present invention, a light emitting diode lamp is provided that includes a light emitting diode, a band-pass filter and a light angle adjuster. The band-pass filter has a light cutoff function to cut off a light ray with a specific wavelength included in light rays emitted from the light emitting diode. The light angle adjuster allows the light rays emitted from the light emitting diode to be incident on the band-pass filter at angles of less than or equal to a maximum incident angle up to which the band-pass filter is capable of exerting the light cutoff function. And the light angle adjuster is a reflector including a reflective surface defined by a paraboloid of revolution. The light emitting diode is mounted to a bottom portion of the reflective surface. The band-pass filter is mounted to an opening of the reflective surface. On an imaginary cross section including the optical axis of the light emitting diode, an angle formed between the optical axis and a straight line is less than or equal to the maximum incident angle, the straight line connects the emission center of the light emitting diode and an edge of the opening of the reflective surface.

According to another aspect of the present invention, a light emitting diode lamp is provided that includes a light emitting diode, a band-pass filter and a light shield. The band-pass filter has a light cutoff function to cut off a light ray with a specific wavelength included in light rays emitted from the light emitting diode. The light shield blocks one or more of the light rays emitted from the light emitting diode when the one or more of the light rays are incident on the band-pass filter at one or more incident angles of greater than a maximum incident angle up to which the band-pass filter is capable of exerting the light cutoff function. And the light shield is a shielding tube having a tubular shape. The light emitting diode is mounted to one end of the shielding tube while the band-pass filter is mounted to the other end of the shielding tube. On an imaginary cross section including an optical axis of the light emitting diode, an angle of less than or equal to the maximum incident angle is formed between the optical axis and an imaginary straight line connecting a light emission center of the light emitting diode and an edge of the other end of the shielding tube.

According to yet another aspect of the present invention, a light emitting diode lamp is provided that includes a light emitting diode, a band-pass filter, a light shield and a light angle adjuster. The band-pass filter has a light cutoff function to cut off a light ray with a specific wavelength included in light rays emitted from the light emitting diode. The light shield blocks at least part of one or more of the light rays emitted from the light emitting diode when the one or more of the light rays are incident on the band-pass filter at one or more incident angles of greater than a maximum incident angle up to which the band pass filter is capable of exerting the light cutoff function. The light angle adjuster allows the unblocked rest of the one or more of the light rays to be incident on the band-pass filter at one or more incident angles of less than or equal to the maximum incident angle. And the light shield is a shielding tube having a tubular shape. The light angle adjuster is a lens. The light emitting diode is mounted to one end of the shielding tube while the band pass filter is mounted to the other end of the shielding tube. The lens is mounted to an internal space of the shielding tube.

According to further yet another aspect of the present invention, a light emitting diode lamp is provided that includes a light emitting diode, a reflector, a heat sink and a band-pass filter. The reflector includes a reflective surface and an opening. The reflective surface is defined by a paraboloid of revolution including a cutout portion. The opening outwardly radiates light rays emitted from the light emitting diode therethrough after the light rays are reflected by the reflective surface. The heat sink holds the light emitting diode such that a position of a light emission center of the light emitting diode is matched with a position of a focal point of the paraboloid of revolution. The heat sink is combined with the reflector so as to include the cutout portion of the paraboloid of revolution defining the reflective surface. The band-pass filter covers the opening of the reflector. The band-pass filter includes an incident side plane arranged orthogonally to a rotational axis of the paraboloid of revolution and the band-pass filter has a function to cut off visible light rays from the light emitting diode. The light shielding member prevents the light emitting diode from being directly seen in a view from the opening side of the reflector at an angle parallel to the rotational axis of the paraboloid of revolution.

It is preferable that the light shielding member is shaped to block one or more of the light rays emitted from the light emitting diode when the one or more of the light rays exit from the opening without being reflected by the reflective surface.

It is preferable that the light shielding member is a portion of the heat sink that is located closer to the opening than the light emitting diode.

It is preferable that the light shielding member is provided with a light absorbing layer disposed on a surface of a portion thereof illuminated by the light rays emitted from the light emitting diode.

According to the present invention, it is possible to provide a light emitting diode lamp that can reduce, as much as possible, chances of emitting light rays with undesired wavelengths in use of a band-pass filter having specific incident angle dependency.

It should be noted that throughout the present specification, the term "paraboloid of revolution" is not limited to a paraboloid of revolution based on a strict mathematical definition, and encompasses even a surface of revolution that light rays are reflected by the reflective surface thereof in somewhat less parallel to each other as long as the significance of the present invention is not thereby disregarded.

Likewise, throughout the present specification, a state "an incident side plane of a band-pass filter is arranged orthogonally to a rotational axis of a paraboloid of revolution" is not limited to an "orthogonal" state strictly defined, and encompasses even a somewhat oblique intersecting state as long as the significance of the present invention is not thereby disregarded. Moreover, throughout the present specification, the term "incident angle" at which a light ray is incident on the band-pass filter refers to an angle formed between the light ray and an imaginary line arranged orthogonally to the incident side plane of the band-pass filter.

BRIEF DESCRIPTION OF THE DRAWINGS

Referring now to the attached drawings which form a part of this original disclosure:

FIG. 12 is a cross-sectional view of the light emitting diode lamp 10 according to yet another modification;

FIG. 13 is a cross-sectional view of the light emitting diode lamp 10 according to yet another modification;

DETAILED DESCRIPTION OF EMBODIMENTS (Configuration of Light Emitting Diode Lamp 10)

A light emitting diode lamp 10 to which the present invention is applied will be hereinafter explained. It should be noted that in the following explanation, reference signs will be set as follows. In use of a plurality of constituent elements having the same structure, a reference sign composed of only an Arabic numeral without any branch number (alphabetic character) will be used for explaining a superordinate concept of the plurality of constituent elements. By contrast, a reference sign composed of the Arabic numeral and a branch number (small alphabetic character) will be used for explaining each of the plurality of constituent elements (i.e., as a subordinate concept) so as to distinguish the plurality of constituent elements from each other.

Figure 1:
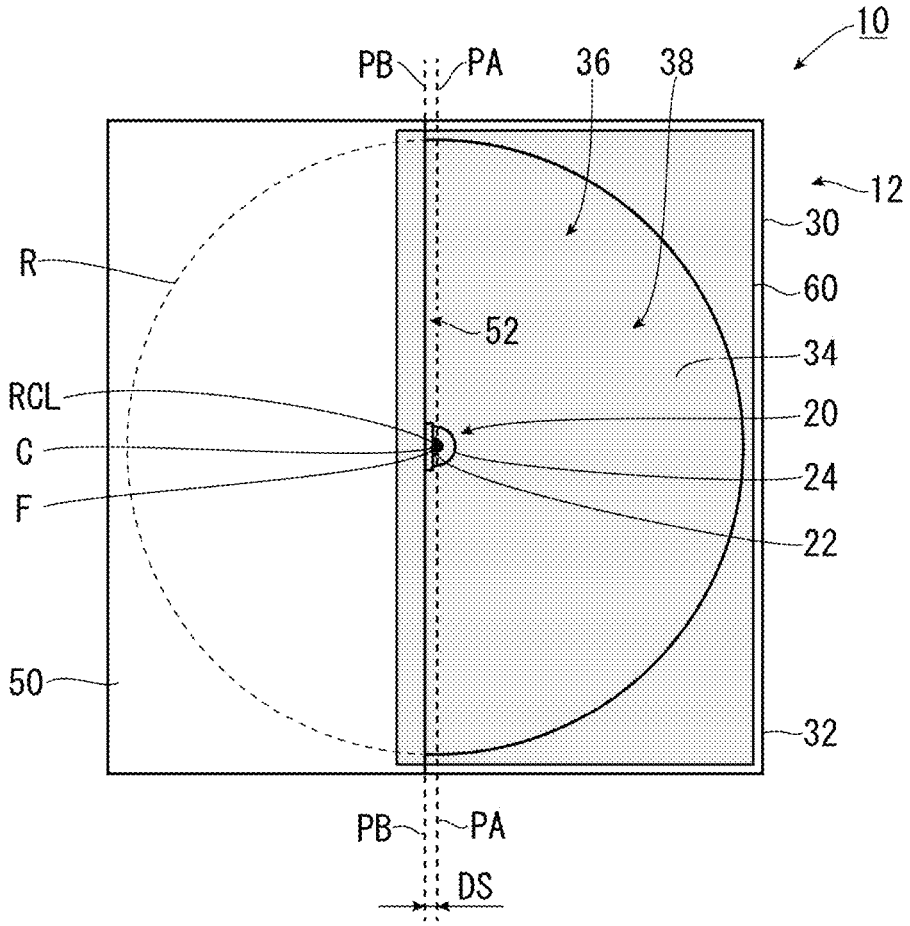
FIG. 1 is a plan view of an exemplary light emitting diode lamp 10 to which the present invention is applied.
Figure 2:
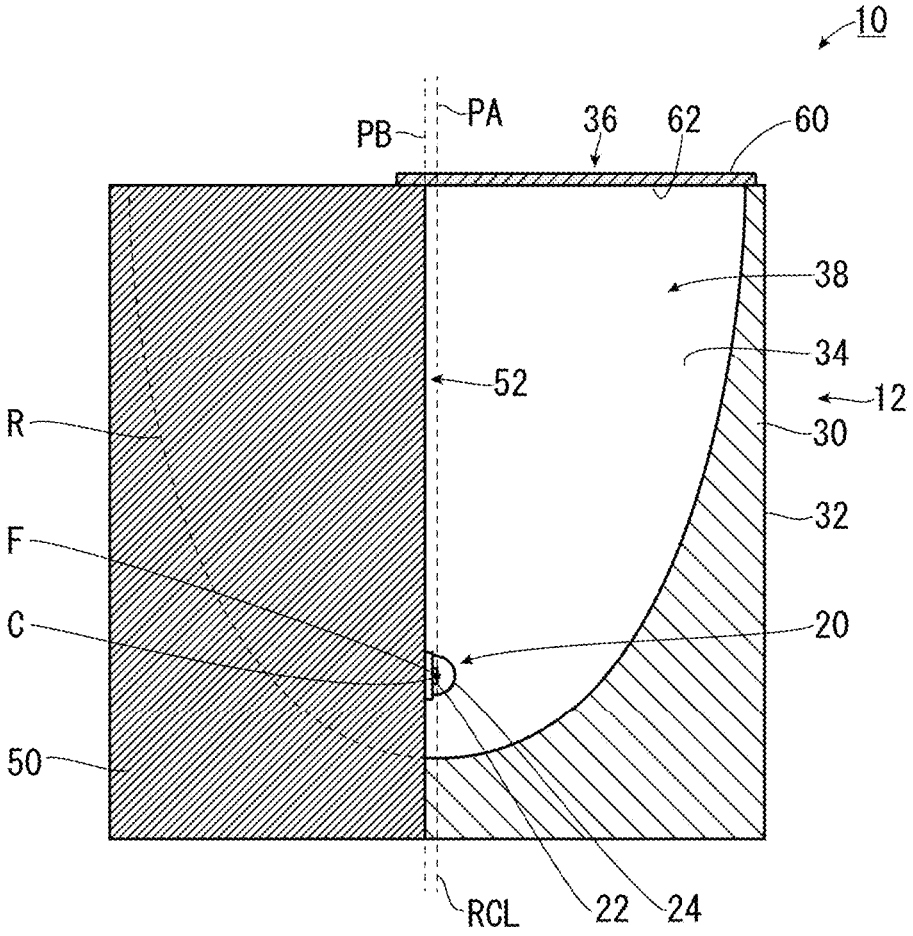
FIG. 2 is a cross-sectional view of the exemplary light emitting diode lamp 10 to which the present invention is applied.

As shown in FIGS. 1 and 2, the light emitting diode lamp 10 mainly includes a light emitting diode 20, a reflector 30 as a light angle adjuster 12, a heat sink 50 and a band-pass filter 60.

The light emitting diode 20 is an electronic component that emits light rays with a predetermined peak wavelength when receiving electric power from the outside. A type of light emitting diode, used as the light emitting diode 20 in the present practical example, is composed of a single light emitting diode element 22 and a light emitting diode lens 24. The light emitting diode element 22 emits infrared light rays with a peak wavelength of greater than or equal to 900 nm and less than or equal to 1100 nm. The light emitting diode lens 24 collects the light rays emitted from the light emitting diode element 22 and distributes the light rays at a predetermined divergence angle. However, the peak wavelength of light rays emitted from the light emitting diode element 22 is not limited to the above. Additionally, a type of light emitting diode, composed of a plurality of light emitting diode elements disposed in alignment, may be used as the light emitting diode 20. Moreover, the light emitting diode lens 24 is not a constituent element indispensable for the present invention.

The reflector 30 includes a reflector body 32, a reflective surface 34 and an opening 36. The reflector body 32 is made of glass or metal such as aluminum. The reflective surface 34 reflects light rays emitted from the light emitting diode 20. The opening 36 is provided for irradiating the light rays reflected by the reflective surface 34 to the outside.

The reflective surface 34 is formed by a paraboloid of revolution with a cutout portion. This will be specifically explained below. The reflective surface 34 of the reflector 30 according to the present practical example is defined by part of a paraboloid of revolution having a rotational axis RCL, which is larger one (including the rotational axis RCL) of two parts of the paraboloid of revolution. The two parts are obtained by cutting the paraboloid of revolution along a cutaway surface PB arranged in parallel to a plane PA including the rotational axis RCL. In other words, the reflective surface 34 is formed by cutting out part of the paraboloid of revolution, which is smaller one of two parts of the paraboloid of revolution. It should be noted that distance DS between the cutaway surface PB and the plane PA including the rotational axis RCL corresponds to distance from the bottom surface to the center of light emission (hereinafter simply referred to as "emission center C") in the light emitting diode 20.

In the present practical example, the heat sink 50 is made in the shape of approximately cuboid. The light emitting diode 20 is mounted and held on the surface of one of the lateral faces of the heat sink 50 (this lateral face will be hereinafter referred to as "light emitting diode mounted lateral face 52"). The light emitting diode mounted lateral face 52 is formed to be matched with the cutaway surface PB that defines the reflective surface 34 of the reflector 30. Additionally, the heat sink 50 has a role of receiving heat generated by the light emitting diode 20 during light emission and then dispersing and radiating the received heat. Because of this, the heat sink 50 is preferably made of material with high thermal conductivity.

Additionally, when the heat sink 50 is combined with the reflector 30, the position of the emission center C of the light emitting diode 20 mounted on the light emitting diode mounted lateral face 52 of the heat sink 50 is configured to be matched with that of a focal point F of the paraboloid of revolution defining the reflective surface 34 of the reflector 30.

Furthermore, the entire shape of the heat sink 50 is designed such that the heat sink 50, when combined with the reflector 30, includes the cutout portion of the paraboloid of revolution defining the reflective surface 34 of the reflector 30, which is the smaller one of two parts of the paraboloid of revolution and does not include the rotational axis RCL (see dotted line R in the drawings).

This combination results in a single concavity 38 surrounded by the reflective surface 34 of the reflector 30 and the light emitting diode mounted lateral face 52 of the heat sink 50. The light emitting diode 20 is designed to be located inside the concavity 38. As a result, light rays emitted from the light emitting diode 20 are configured to exit to the outside through the opening 36 and the band-pass filter 60 without being undesirably leaked to the surroundings. Additionally, the heat sink 50 is exposed to the outside of the light emitting diode lamp 10. Hence, it is advantageous in that heat generated by the light emitting diode 20 during light emission is easily released to the outside through the heat sink 50.

It should be noted that the heat sink 50 includes a power supply circuit for supplying electricity to the light emitting diode 20 as well, although this is not shown in the drawings. The power supply circuit may be formed on the surface of the heat sink 50, or alternatively, may be formed inside the heat sink 50. Obviously, the power supply circuit may directly supply electricity to the light emitting diode 20 through a power supply cable or so forth.

The band-pass filter 60 is a thin plate material having a light cutoff function that allows only light rays with wavelengths falling within a predetermined range to transmit therethrough but blocks (shields) light rays with wavelengths out of the predetermined range (light rays with wavelengths of less than or equal to 920 nm in the present practical example) from transmitting therethrough. A type of band-pass filter, used as the band-pass filter 60 in the present practical example, is made of a multilayer film having a function to cut off light rays with wavelengths in a visible range (i.e., visible light rays). Obviously, the wavelength range of light rays allowed to transmit through the band-pass filter 60 is determined in accordance with the wavelengths of light rays required for the light emitting diode lamp 10.

As described above, the band-pass filter 60 has "incident angle dependency". Because of this, the band-pass filter 60 cannot cut off light rays incident thereon at incident angles greater than a predetermined angle. For example, the band-pass filter 60 according to the present practical example is capable of exerting the light cutoff function with respect to light rays incident thereon at incident angles of up to about 11 degrees in spite of the incident angle dependency thereof as described below. In other words, when visible light rays are incident on an incident side plane 62 of the band-pass filter 60 at incident angles of greater than 11 degrees, those visible light rays are configured to exit from the light emitting diode lamp 10 without being cut off by the band-pass filter 60.

The band-pass filter 60 according to the present practical example is designed to cover the opening 36 of the reflector 30, with the incident side plane 62 thereof being orthogonal to the rotational axis RCL of the paraboloid of revolution defining the reflective surface 34.

Here, explanation will be provided for the maximum incident angle, up to which the band-pass filter 60 is capable of exerting the light cutoff function in spite of the incident angle dependency thereof. The center wavelength of light rays transmitting through the band-pass filter 60 at a given incident angle θ (hereinafter referred to as "transmission center wavelength $\lambda_{C\theta}$") can be obtained by the following equation.

$$\lambda_{C\theta}=\lambda_0\times(1-\sin^2\theta)^{0.5},$$

where $\lambda_0$: the transmission center wavelength [nm] in vertical incidence (at an incident angle of 0 degrees), and $\lambda_{C\theta}$: the transmission center wavelength [nm].

However, the transmission center wavelength $\lambda_{C\theta}$ obtained by this equation is the center wavelength of light rays transmitting through the band-pass filter 60, and is not transmission lower limit wavelength $\lambda_{L\theta}$ of light rays allowed to transmit through the band-pass filter 60 (in other words, the maximum wavelength of light rays prevented from transmitting through the band-pass filter 60). In view of this, the following equation is formed with the transmission lower limit wavelength $\lambda_{L\theta}$ that depends on filters used as the band-pass filter 60.

$$\lambda_{L\theta}=\lambda_0\times(1-\sin^2\theta)^{0.5}-\alpha,$$

where $\lambda_0$: the transmission center wavelength [nm] in vertical incidence (at an incident angle of 0 degrees), $\lambda_{L\theta}$: the transmission lower limit wavelength [nm], and α: (the transmission center wavelength $\lambda_{C\theta}$ of the band-pass filter 60 [nm])−(the transmission lower limit wavelength $\lambda_{L\theta}$ [nm]).

Based on the aforementioned equation, the maximum incident angle θ can be calculated by setting the transmission lower limit wavelength $\lambda_{L\theta}$.

For example, the maximum incident angle θ is 11 degrees in use of the band-pass filter 60 that the transmission lower limit wavelength $\lambda_{L\theta}$ is 920.5 nm, which is close to 920 nm as the maximum wavelength of red light invisible for human eyes, and the transmission center wavelength $\lambda_0$ is 930 nm. Now, generally speaking, the wavelength of visible light is around 780 to 800 nm. However, the inventors of the present application conducted experiments for 35 subjects, and found that all the subjects can see light with a wavelength of up to 910 nm but can no longer see light with a wavelength of 920 nm or greater. Based on the experimental result, the maximum wavelength of red light invisible for human eyes is set to 920 nm as described above.

(Assemblage of Light Emitting Diode Lamp 10)

Procedure of assembling the light emitting diode lamp 10 will be briefly explained. First, the light emitting diode 20 is mounted to the light emitting diode mounted lateral face 52 of the heat sink 50 molded in a predetermined shape. The method of mounting the light emitting diode 20 to the heat sink 50 is not limited to a specific method. However, it is preferable to select a method whereby heat generated by the light emitting diode 20 during light emission can be efficiently transferred to the heat sink 50. For example, it can be assumed to bond the light emitting diode 20 to the surface of the heat sink 50 by adhesive with high thermal conductivity. Additionally, the power supply circuit is implemented on the light emitting diode 20, while the light emitting diode 20 is mounted to the heat sink 50.

Thereafter, the heat sink 50 is combined with the reflector 30, and finally, the band-pass filter 60 is mounted to cover the opening 36 of the reflector 30 (more precisely, the concavity 38 formed when the heat sink 50 is combined with the reflector 30). Assemblage of the light emitting diode lamp 10 is thus completed.

(Features of Light Emitting Diode Lamp 10)

Figure 3:
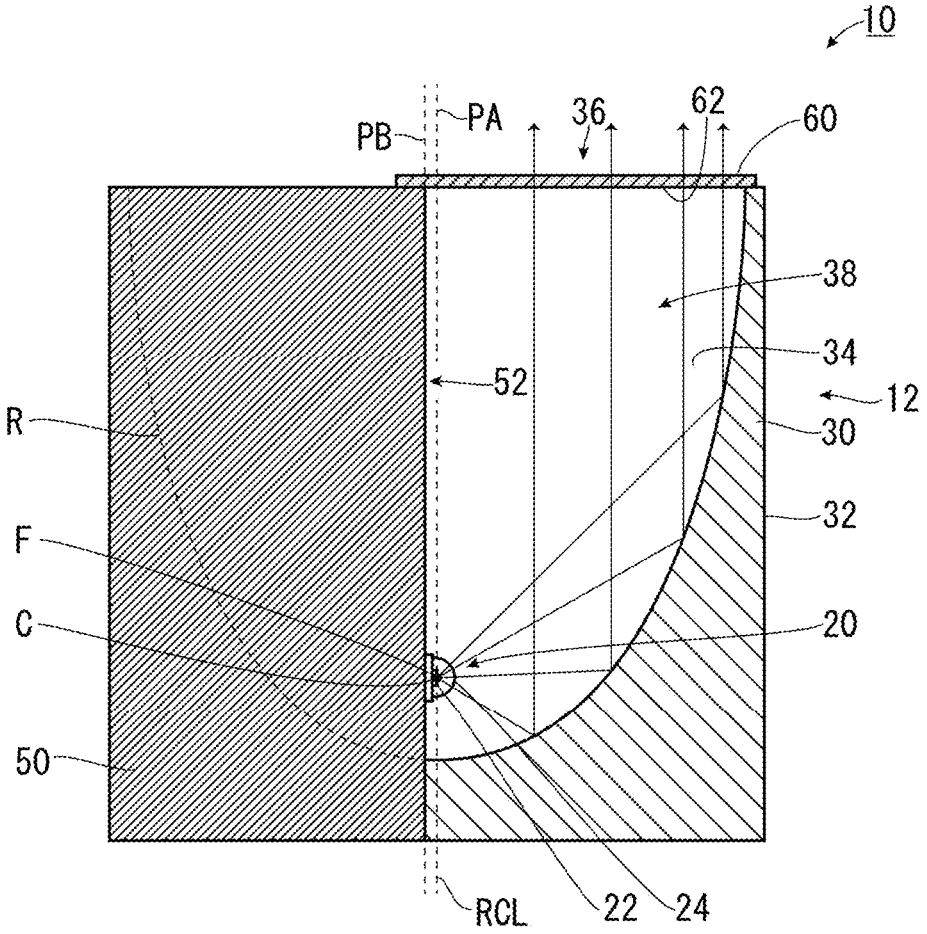
FIG. 3 is a cross-sectional view of the exemplary light emitting diode lamp 10 to which the present invention is applied.

According to the light emitting diode lamp 10 of the present practical example, the light emitting diode 20 is held such that the position of the emission center C thereof is matched with that of the focal point F of the paraboloid of revolution forming the reflective surface 34 of the reflector 30. Accordingly, as shown in FIG. 3, light rays emitted from the light emitting diode 20 are reflected by the reflective surface 34. The reflected light rays exit from the opening 36 in the form of collimated light arranged in parallel to the rotational axis RCL of the paraboloid of revolution. On the other hand, the band-pass filter 60 is disposed to cover the opening 36 of the reflector 30 such that the incident side plane 62 thereof is arranged orthogonally to the rotational axis RCL of the paraboloid of revolution. In other words, the collimated light, exiting from the opening 36 of the reflector 30, is incident on the incident side plane 62 of the band-pass filter 60 in an approximately perpendicular manner (at an incident angle of approximately zero). Therefore, even when the band-pass filter 60 has strong incident angle dependency (i.e., when light rays are allowed to be incident on the band-pass filter 60 in a narrow range of incident angles), it is possible to reduce, as much as possible, chances of emitting light rays with undesired wavelengths from the light emitting diode lamp 10.

(Modification 1)

Figure 4:
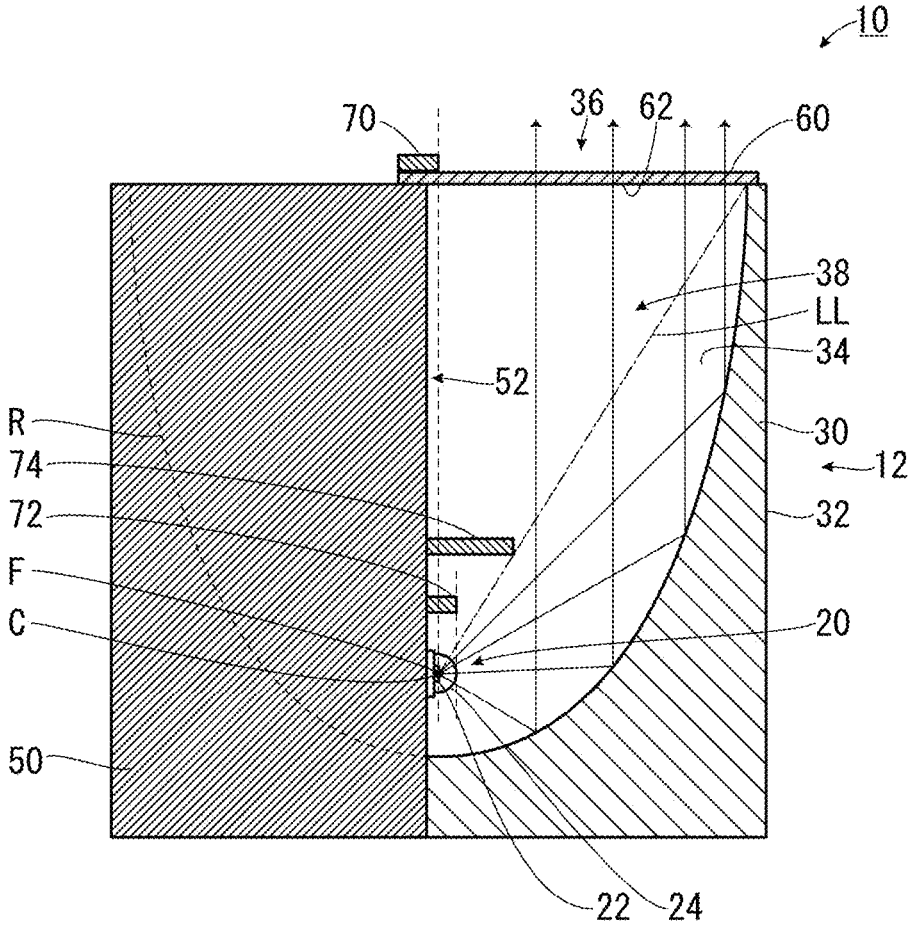
FIG. 4 is a cross-sectional view of the light emitting diode lamp 10 according to a modification.

As shown in FIG. 4, at least one of light shielding members 70, 72 and 74 may be added, as a constituent element, to the light emitting diode lamp 10 according to the aforementioned practical example. The light shielding members 70, 72 and 74 are provided for preventing the light emitting diode 20 from being directly seen when the light emitting diode lamp 10 is seen at an angle parallel to the rotational axis RCL of the paraboloid of revolution (i.e., from the front side of the light emitting diode lamp 10). It should be noted that the material, of which the light shielding members 70, 72 and 74 are made, is not limited to a specific material as long as the light shielding members 70, 72 and 74 can block light rays emitted from the light emitting diode 20. For example, metal, opaque resin, ceramic material or so forth can be assumed as the material of the light shielding members 70, 72 and 74.

The lengths of the light shielding members 70, 72 and 74 are set as follows. For example, as with the light shielding member 70, the length is set to block light rays at least in a range from the position corresponding to the light emitting diode mounted lateral face 52 of the heat sink 50 to the emission center C of the light emitting diode 20. Instead of this, as with the light shielding member 72, the length may be set to block light rays in a range from the position corresponding to the light emitting diode mounted lateral face 52 of the heat sink 50 to the tip of the light emitting diode lens 24 composing part of the light emitting diode 20. Furthermore, as with the light shielding member 74, the length may be elongated to an imaginary straight line LL connecting the emission center C of the light emitting diode 20 and the opening 36-side end of the reflective surface 34. When the length is elongated as with the light shielding member 74, it is possible to block light rays that are emitted from the emission center C and travel directly toward the opening 36 without being reflected by the reflective surface 34 (i.e., light rays incident on the band-pass filter 60 at large incident angles).

Additionally, the light shielding member 70 may be disposed in an arbitrary position as long as the position is above the light emitting diode 20 (on a side directed toward the opening 36). FIG. 4 shows the light shielding members 72 and 74, both of which are protruded from the light emitting diode mounted lateral face 52 of the heat sink 50, and the light shielding member 70 mounted along the upper surface of the band-pass filter 60. However, it is only required to select any of the light shielding members 70, 72 and 74. Additionally, light absorbing material or layer (e.g., black coating film that will be hereinafter similarly applied as an example of the light absorbing material) may be disposed on the surface of each light shielding member 70, 72, 74 in opposition to the light emitting diode 20 in order to avoid a situation that light rays, when striking the light shielding members 70, 72 and 74, are reflected and exit from the opening 36 at undesired angles.

(Modification 2)

Figure 5:
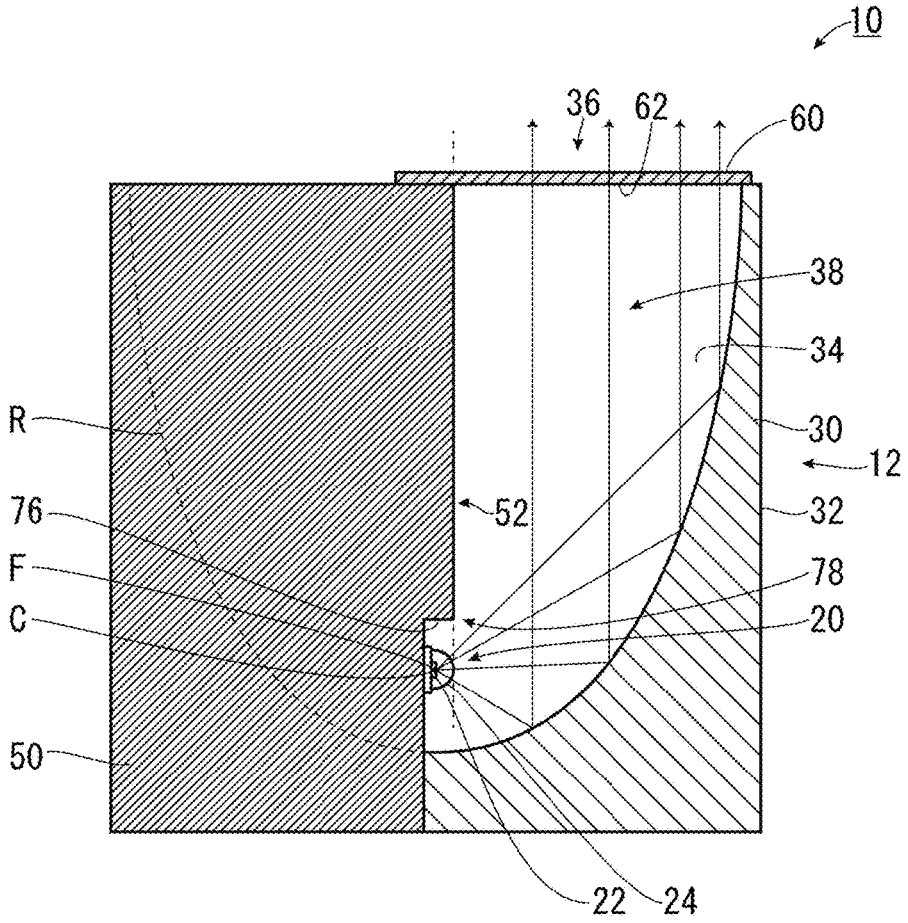
FIG. 5 is a cross-sectional view of the light emitting diode lamp 10 according to another modification.

Moreover, the heat sink 50 and a light shielding member 78 may be integrated unlike the configuration shown in FIG. 4 that the light shielding members 70, 72 and 74 provided separately from the heat sink 50 are mounted in place. As shown in FIG. 5, at least part of the heat sink 50, located above the light emitting diode 20, is protruded toward the reflective surface 34 so as to form a step 76, as the light shielding member 78, on the light emitting diode mounted lateral face 52 of the heat sink 50 as seen in a cross-sectional view along the up-and-down direction. Accordingly, it is possible to achieve advantageous effects similar to those achieved by forming the light shielding members 70, 72 and 74 provided separately from the heat sink 50 as shown in FIG. 4. Additionally, the light absorbing material may be disposed on the surface of the step 76 in opposition to the light emitting diode 20 in order to avoid a situation that light rays, when striking the light shielding member 78, are reflected and exit from the opening 36 at undesired angles.

(Modification 3)

Figure 6:
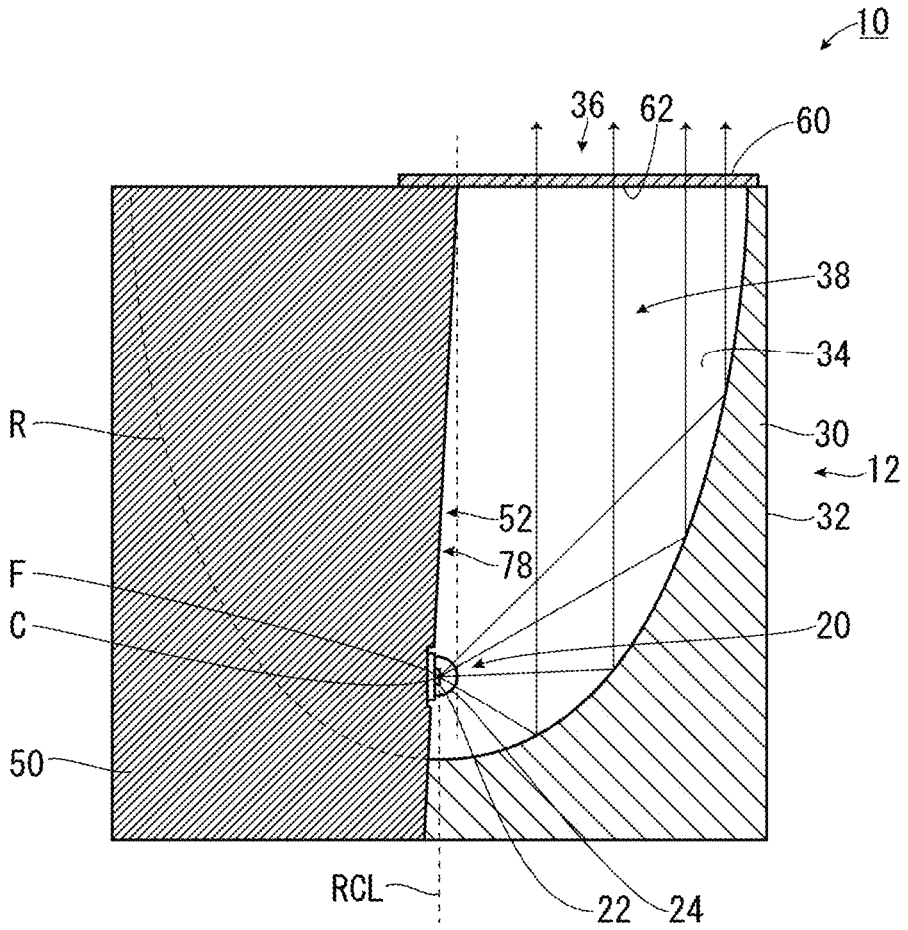
FIG. 6 is a cross-sectional view of the light emitting diode lamp 10 according to yet another modification.

Furthermore, FIG. 6 shows another example of integrating the heat sink 50 and the light shielding member 78. The light emitting diode mounted lateral face 52 of the heat sink 50 may be formed to slant as seen in a cross-sectional view along the up-and-down direction. This will be specifically explained. The light emitting diode mounted lateral face 52 is shaped to slant with respect to the rotational axis RCL as seen in the cross-sectional view along the up-and-down direction such that the position of the emission center C of the light emitting diode 20 is matched with that of the focal point F of the paraboloid of revolution defining the reflective surface 34, while the opening 36-side end (the upward end) of the light emitting diode mounted lateral face 52 is at least located in a position corresponding to the emission center C of the light emitting diode 20. Accordingly, part of the light emitting diode mounted lateral face 52, located above the light emitting diode 20, is entirely enabled to function as the light shielding member 78. Additionally, the light absorbing material may disposed on the surface corresponding to the light shielding member 78 in order to avoid a situation that light rays, when striking this surface, are reflected and exit from the opening 36 at undesired angles.

(Modification 4)

Figure 7:
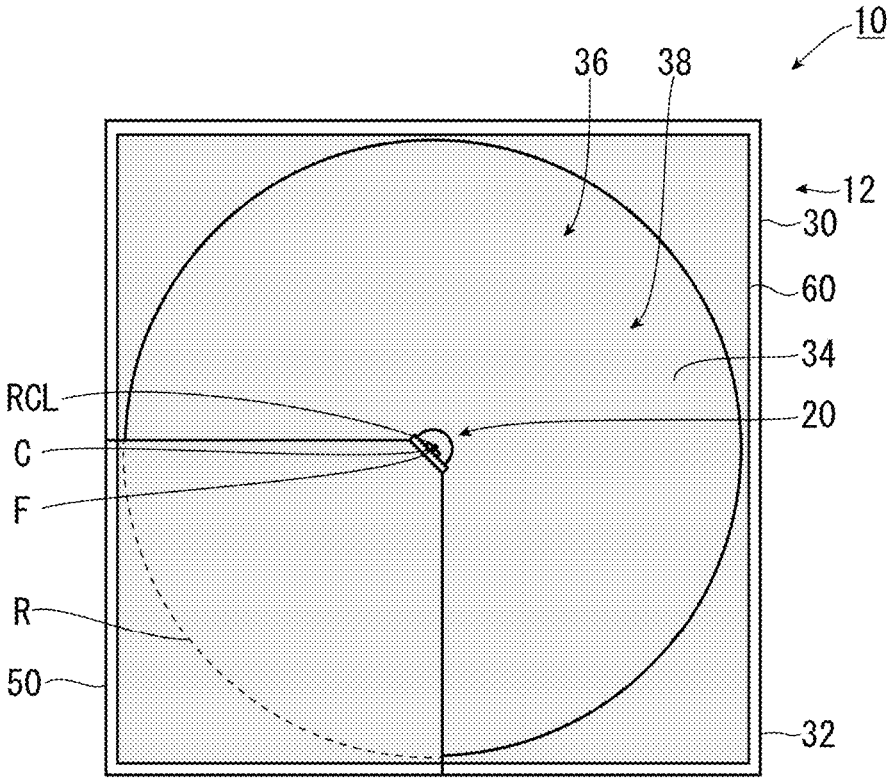
FIG. 7 is a plan view of the light emitting diode lamp 10 according to yet another modification.
Figure 8:
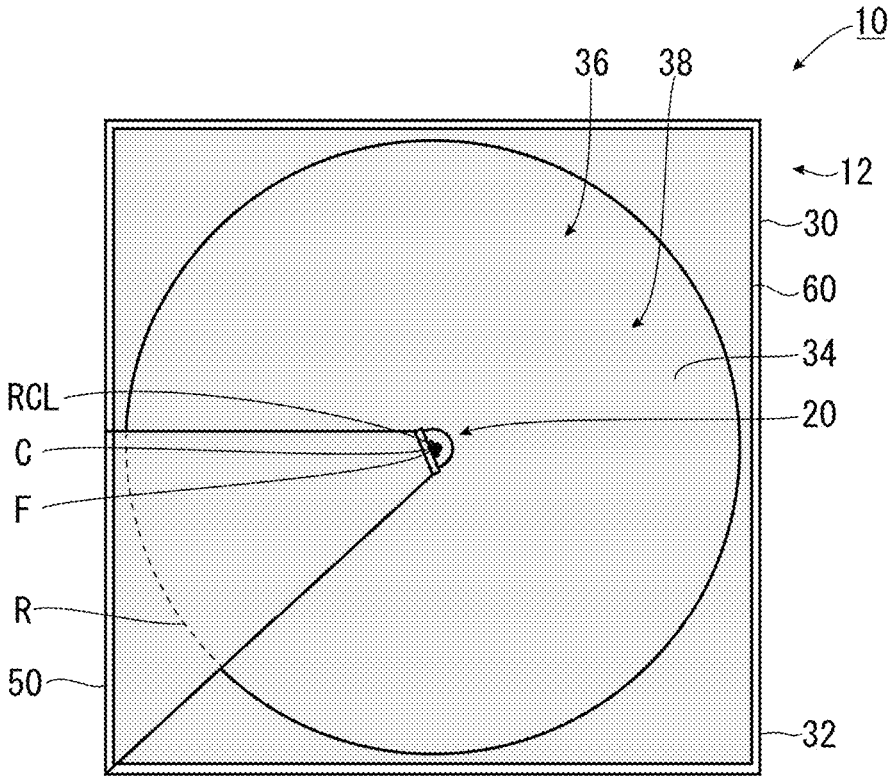
FIG. 8 is a plan view of the light emitting diode lamp 10 according to yet another modification.

In the aforementioned practical example, the paraboloid of revolution having the rotational axis RCL is cut along the cutaway surface PB arranged in parallel to the plane PA including the rotational axis RCL, and resultant two parts of the paraboloid of revolution are composed of a larger one and a smaller one. The reflective surface 34 of the reflector 30 is defined by the larger one of the two parts (i.e., the one including the rotational axis RCL). However, the reflective surface 34 is not limited to this aspect as long as the reflective surface 34 is defined by a paraboloid of revolution including a cutout portion. For example, as shown in FIG. 7, the reflective surface 34 may be defined by a paraboloid of revolution that one-fourth thereof (a sector with a central angle of 90 degrees) is cut out about the rotational axis RCL thereof. Alternatively, as shown in FIG. 8, the reflective surface 34 may be defined by a paraboloid of revolution that one-eighth thereof (a sector with a central angle of approximately 45 degrees) is cut out about the rotational axis RCL thereof. In either case, when combined with the reflector 30, the heat sink 50 is configured to include the cutout portion of the paraboloid of revolution defining the reflective surface 34 of the reflector 30 (see dotted line R in FIGS. 7 and 8).

Accordingly, the single concavity 38 is formed while being surrounded by the reflective surface 34 of the reflector 30 and the light emitting diode mounted lateral face 52 of the heat sink 50, and the light emitting diode 20 is located inside the concavity 38. As a result, light rays emitted from the light emitting diode 20 can exit to the outside through the band-pass filter 60 without being undesirably leaked to the surroundings. Additionally, the heat sink 50 is directly exposed to the outside of the light emitting diode lamp 10. Hence, it is advantageous in that heat generated by the light emitting diode 20 during light emission is likely to be released to the outside through the heat sink 50.

(Modification 5)

Figure 9:
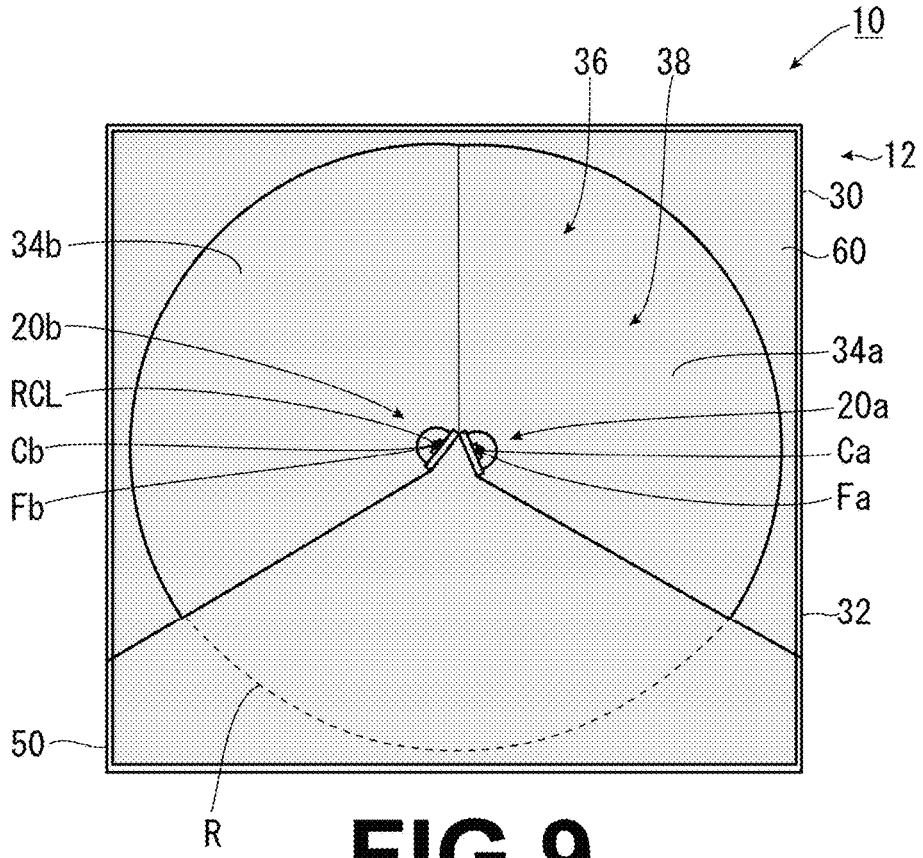
FIG. 9 is a plan view of the light emitting diode lamp 10 according to yet another modification.

Furthermore, as shown in FIG. 9, the light emitting diode lamp 10 may be formed by combining a pair of light emitting diodes 20*a* and 20*b* and reflective surfaces 34*a* and 34*b*. The reflective surface 34*a* is relevant to the light emitting diode 20*a*, whereas the reflective surface 34*b* is relevant to the light emitting diode 20*b*. The reflective surfaces 34*a* and 34*b* include different focal points Fa and Fb, respectively. Emission centers Ca and Cb of the light emitting diodes 20*a* and 20*b* are matched with the focal points Fa and Fb of the reflective surfaces 34*a* and 34*b* relevant to the light emitting diodes 20*a* and 20*b*, respectively.

Accordingly, even when the light emitting diode lamp 10 is formed with the plural light emitting diodes 20*a* and 20*b*, the emission centers Ca and Cb of the light emitting diodes 20*a* and 20*b* can be matched with the focal points Fa and Fb of the reflective surfaces 34*a* and 34*b*, respectively. Hence, it is possible to reduce light rays that are irradiated from the light emitting diodes 20*a* and 20*b* while being displaced from the focal points Fa and Fb, and are then reflected by the reflective surfaces 34*a* and 34*b* but do not travel in the form of collimated light. As a result, even in use of the plural light emitting diodes 20*a* and 20*b*, it is possible to reduce, as much as possible, chances of emitting light rays with undesired wavelengths from the light emitting diode lamp 10 in spite of the incident angle dependency of the band-pass filter 60.

(Modification 6)

Figure 10:
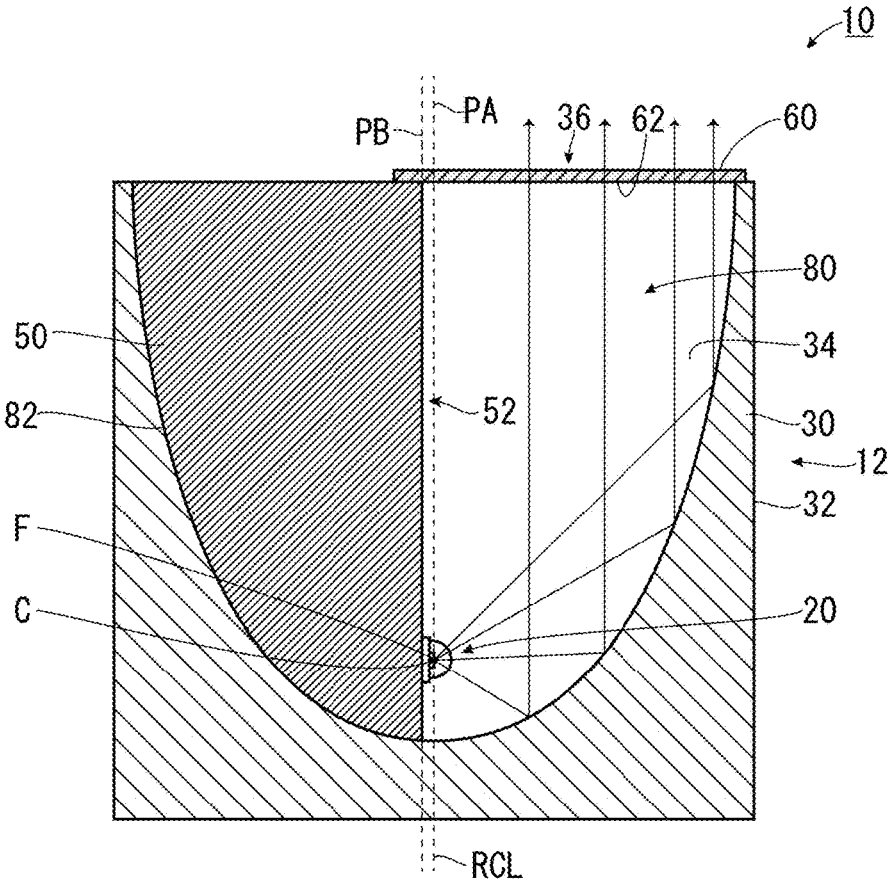
FIG. 10 is a cross-sectional view of the light emitting diode lamp 10 according to yet another modification.

Furthermore, a configuration shown in FIG. 10 is also classified as a variation of the configuration that the heat sink 50 includes the cutout portion of the paraboloid of revolution defining the reflective surface 34 of the reflector 30. In the light emitting diode lamp 10 shown in FIG. 10, the reflector 30 includes a concavity 80 defined by a complete paraboloid of revolution (without any cutout portion). Additionally, the heat sink 50 includes a curved surface 82 on the opposite side of the light emitting diode mounted lateral face 52. The curved surface 82 is defined by part of the same paraboloid of revolution as that defining the concavity 80.

The heat sink 50 is mounted to the interior of the concavity 80, while the curved surface 82 is fitted in contact with the surface of the concavity 80 of the reflector 30. At this time, the light emitting diode mounted lateral face 52 of the heat sink 50 is configured to be matched with the cutaway surface PB described in the aforementioned practical example, whereas the position of the emission center C of the light emitting diode 20 is configured to be matched with that of the focal point F of the paraboloid of revolution defining the concavity 80. Additionally, an area of the surface of the concavity 80, not in contact with the curved surface 82 of the heat sink 50, is formed as the reflective surface 34.

Even in the light emitting diode lamp 10 shown in FIG. 10, heat generated by the light emitting diode 20 during light emission is configured to be transferred from the curved surface 82 of the heat sink 50 to the reflector body 32 through the surface of the concavity 80, and be then released to the outside from the reflector body 32.

(Modification 7)

Figure 11:
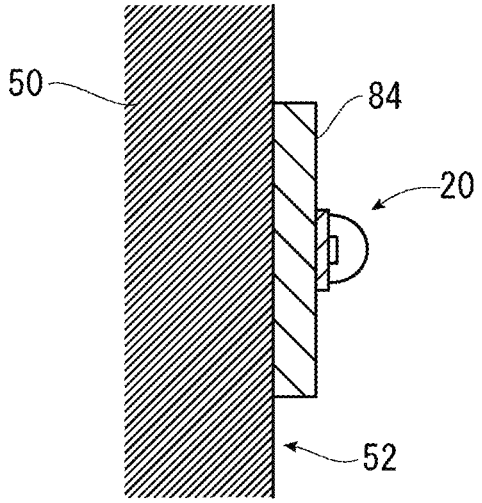
FIG. 11 is a cross-sectional view of an exemplary aspect to attach a light emitting diode 20 to a heat sink 50.

In the aforementioned practical example, the light emitting diode 20 is designed to be directly attached to the light emitting diode mounted lateral face 52 of the heat sink 50. However, the light emitting diode 20 may be attached to the heat sink 50 in an arbitrary aspect as long as the position of the emission center C thereof is matched with that of the focal point F of the paraboloid of revolution defining the reflective surface 34. For example, as shown in FIG. 11, the light emitting diode 20 may be mounted to a mount board 84, and thereafter, the mount board 84 may be attached, together with the light emitting diode 20 mounted thereto, to the light emitting diode mounted lateral face 52 of the heat sink 50 by means of bonding or so forth.

(Modification 8)

Furthermore, as shown in FIG. 12, a condenser lens 39 may be added, as the light angle adjuster 12, to the front side of the light emitting diode 20. The position of a focal point F1 of the condenser lens 39 is matched with that of the emission center C of the light emitting diode 20 and that of the focal point F of the paraboloid of revolution. In using the reflector 30 that includes the reflective surface 34 having as narrow an angular range as possible about the rotational axis RCL of the paraboloid of revolution, the usage of the condenser lens 39 enables emission of the same amount of light rays as emission in using the reflector 30 that includes the reflective surface 34 having as wide an angular range as possible about the rotational axis RCL of the paraboloid of revolution.

(Other Modifications)

As described above, in using the reflector 30, as the light angle adjuster 12, which includes the reflective surface 34 defined by the paraboloid of revolution with the cutout portion, it is difficult to output light rays with a circular cross section due to the shape of the reflective surface 34 of the reflector 30. However, it is possible to easily output light rays with a circular cross section by the configurations of the following modifications.

(Modification 9)

In the aforementioned practical example, the reflector 30 is used as the light angle adjuster 12. However, the light angle adjuster 12 is not limited to this. For example, as shown in FIG. 13, a lens 90 may be used as the light angle adjuster 12.

This will be specifically explained. The lens 90 is mounted between the light emitting diode 20 and the band-pass filter 60, and the position of the lens 90 and that of the light emitting diode 20 are adjusted to each other such that the position of a focal point F2 of the lens 90 is matched with that of the emission center C of the light emitting diode 20. Additionally, the position of the lens 90 and that of the band-pass filter 60 are adjusted to each other such that a center axis LCL of the lens 90 is arranged orthogonally to the incident side plane 62 of the band-pass filter 60.

Accordingly, approximately all light rays emitted from the light emitting diode 20 are deflected by the lens 90, and thereafter, are incident on the band-pass filter 60 in the form of collimated light arranged in parallel to the center axis LCL of the lens 90. At this time, as described above, adjustment is made such that the center axis LCL of the lens 90 is arranged orthogonally to the incident side plane 62 of the band-pass filter 60. Hence, the collimated light exiting from the lens 90 is configured to be incident on the incident side plane 62 of the band-pass filter 60 in an approximately perpendicular manner (at an incident angle of approximately zero). Therefore, even when the band-pass filter 60 has strong incident angle dependency (i.e., when light rays are allowed to be incident on the band-pass filter 60 in a narrow range of incident angles), it is possible to reduce, as much as possible, chances of emitting light rays with undesired wavelengths from the light emitting diode lamp 10.

(Modification 10)

Figure 14:
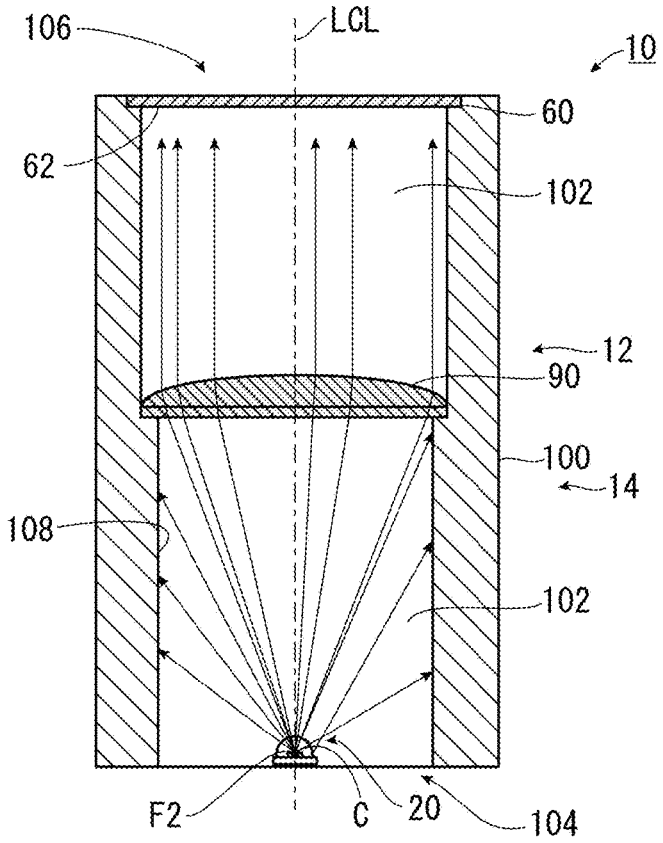
FIG. 14 is a cross-sectional view of the light emitting diode lamp 10 according to yet another modification.

Furthermore, the lens 90 provided as the light angle adjuster 12 and a light shielding tube 100 provided as the light shield 14 may be used in combination. For example, as shown in FIG. 14, the lens 90 is mounted to an internal space 102 of the light shielding tube 100. Then, the light emitting diode 20 is mounted to one end 104 of the light shielding tube 100 so as to emit light rays toward the internal space 102. Moreover, the band-pass filter 60 is mounted to the other end 106 of the light shielding tube 100. The positional relation between the emission center C of the light emitting diode 20 and the focal point F2 of the lens 90 and the positional relation between the center axis LCL of the lens 90 and the incident side plane 62 of the band-pass filter 60 are the same as those explained in Modification 9.

Accordingly, among light rays emitted from the light emitting diode 20, some directly enter the lens 90 without striking an inner surface 108 of the light shielding tube 100, and exit therefrom in the form of collimated light arranged in parallel to the center axis LCL of the lens 90. Then, during passage through the band-pass filter 60, light rays with a predetermined range of wavelength are blocked. Hence, it is possible to output light rays with a desired range of wavelength from the light emitting diode lamp 10.

Contrarily, among the light rays emitted from the light emitting diode 20, some strike the inner surface 108 of the light shielding tube 100 and are reduced in amount because of absorption by the inner surface 108 or so forth. Therefore, light rays, which enter the lens 90 at undesired angles and do not travel in the form of collimated light arranged in parallel to the center axis LCL, are reduced in amount. Accordingly, it is possible to reduce, as much as possible, chances that light rays with an undesired range of wavelength are included in light rays passing through the band-pass filter 60. In this regard, it is further preferable to dispose the light absorbing material on the inner surface 108 of the light shielding tube 100 by coating or so forth. As described above, the light shielding tube 100 according to the present modification has a function to cut off at least part of light rays incident on the band-pass filter 60 at incident angles greater than the maximum incident angle, up to which the band-pass filter 60 is capable of exerting the light cutoff function.

(Modification 11)

Figure 15:
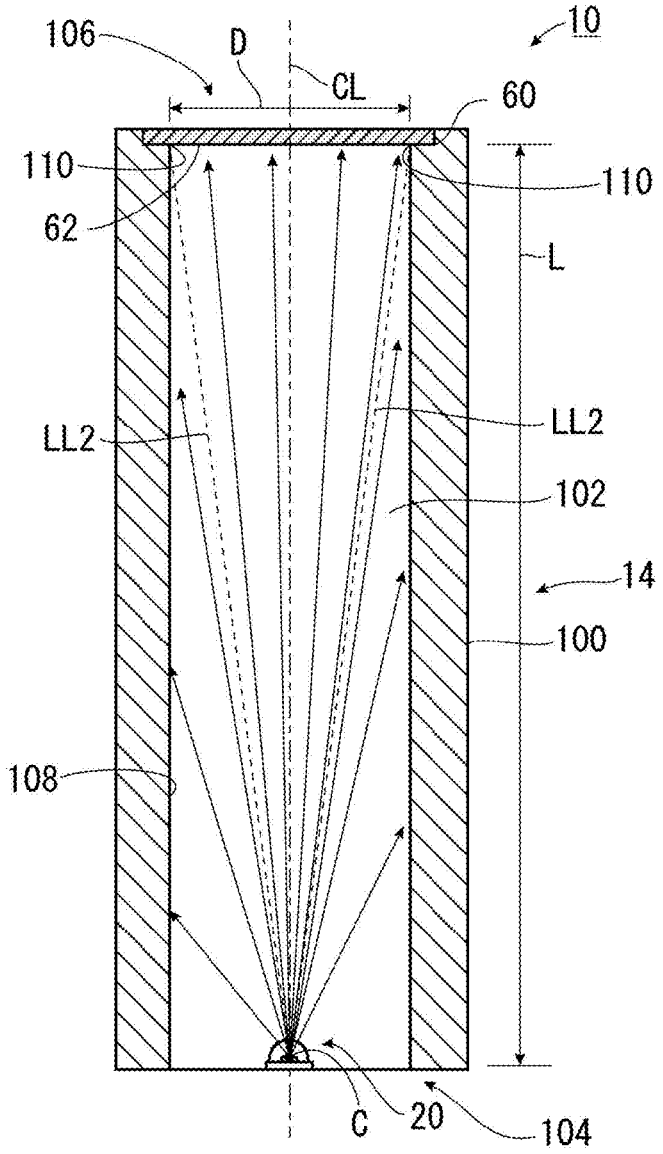
FIG. 15 is a cross-sectional view of the light emitting diode lamp 10 according to yet another modification.

Without using the light angle adjuster 12, the light emitting diode lamp 10 may be formed only by the light shielding tube 100 provided as the light shield 14. For example, as shown in FIG. 15, the light emitting diode 20 is mounted to the one end 104 of the light shielding tube 100, whereas the band-pass filter 60 is mounted to the other end 106 of the light shielding tube 100. In this modification, length L of the light shielding tube 100 and diameter D of the other end 106 are set such that on an imaginary cross section including an optical axis CL of the light emitting diode 20, an angle formed by the optical axis CL and an imaginary straight line LL2 is less than or equal to an angle (of, e.g., 10 degrees) based on the incident angle dependency of the band-pass filter 60. The imaginary straight line LL2 herein connects the emission center C of the light emitting diode 20 and the edge of the other end 106 (other end edge 110) of the light shielding tube 100. It should be noted that the position of the light emitting diode 20 and that of the band-pass filter 60 are adjusted to each other such that the optical axis CL of the light emitting diode 20 is arranged orthogonally to the incident side plane 62 of the band-pass filter 60.

Accordingly, among light rays emitted from the light emitting diode 20, some pass through the band-pass filter 60 and exit from the light shielding tube 100 when angles formed between those light rays and the optical axis CL are less than or equal to the maximum incident angle (of, e.g., 11 degrees) based on the incident angle dependency of the band-pass filter 60. By contrast, some strike the inner surface 108 and are reduced in amount because of absorption by the inner surface 108 or so forth when angles formed between those light rays and the optical axis CL are greater than the maximum incident angle (of, e.g., 11 degrees) based on the incident angle dependency of the band-pass filter 60. Therefore, it is possible to reduce, as much as possible, chances that light rays with an undesired range of wavelength are included in light rays passing through the band-pass filter 60. In this regard, it is further preferable to dispose the light absorbing material on the inner surface 108 of the light shielding tube 100 by coating or so forth. As described above, the light shielding tube 100 according to the present modification has a function to cut off light rays incident on the band-pass filter 60 at incident angles greater than the maximum incident angle, up to which the band-pass filter 60 is capable of exerting the light cutoff function.

(Modification 12)

Figure 16:
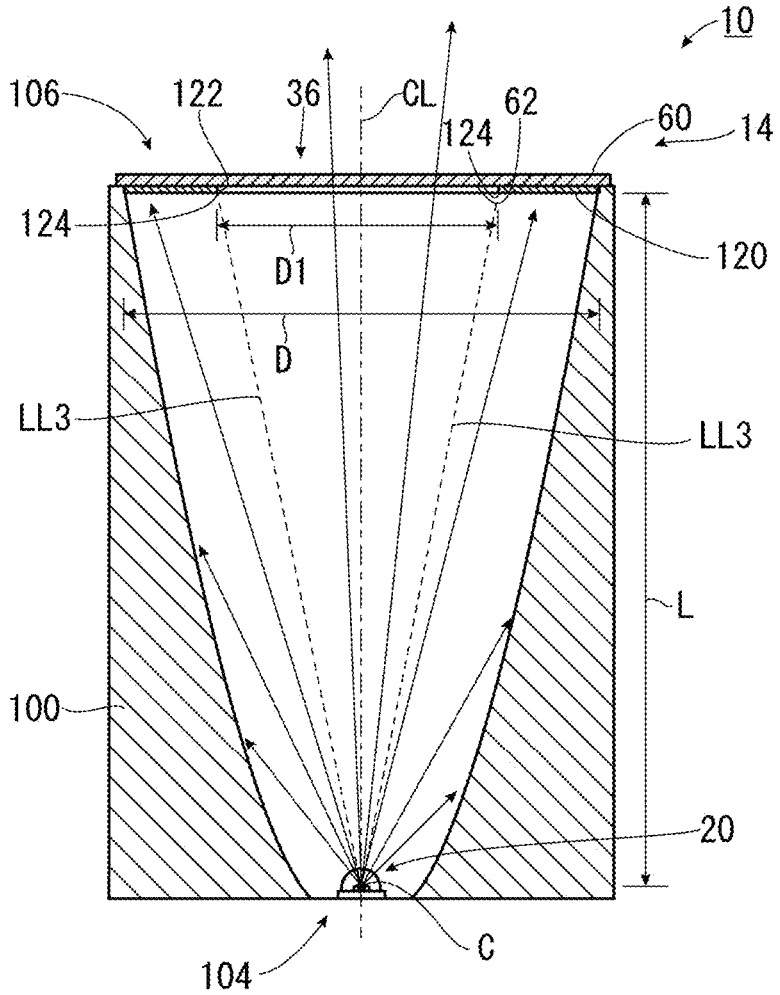
FIG. 16 is a cross-sectional view of the light emitting diode lamp 10 according to yet another modification.

For example, as shown in FIG. 16, the light shield 14 may be formed by a light shielding plate 120. The light shielding plate 120 is a plate material mounted along either the incident side plane 62 or its opposite plane of the band-pass filter 60. The light shielding plate 120 is provided with a light passage hole 122. It should be noted that the position of the light emitting diode 20 and that of the band-pass filter 60 are adjusted to each other such that the optical axis CL of the light emitting diode 20 is arranged orthogonally to the incident side plane 62 of the band-pass filter 60. It is further preferable to dispose the light absorbing material, by coating or so forth, on the surface of the light shielding plate 120 in opposition to the light emitting diode 20.

Diameter D1 of the light passage hole 122 in the light shielding plate 120 is determined in accordance with distance L from the emission center C of the light emitting diode 20 to the light shielding plate 120. In other words, the distance L and the diameter D1 of the light passage hole 122 are set such that on an imaginary cross section including the optical axis CL of the light emitting diode 20, an angle formed by the optical axis CL and an imaginary straight line LL3 is less than or equal to the maximum incident angle (of, e.g., 11 degrees) based on the incident angle dependency of the band-pass filter 60. The imaginary straight line LL3 herein connects the emission center C of the light emitting diode 20 and an edge 124 of the light passage hole 122 in the light shielding plate 120.

Accordingly, among light rays emitted from the light emitting diode 20, some pass through the light passage hole 122 in the light shielding plate 120 and then pass through the band-pass filter 60 when angles formed between those light rays and the optical axis CL are less than or equal to the maximum incident angle (of, e.g., 11 degrees) based on the incident angle dependency of the band-pass filter 60. By contrast, some strike the light shielding plate 120 and are reduced in amount because of absorption by the light shielding plate 120 or so forth when angles formed between those light rays and the optical axis CL are greater than the maximum incident angle (of, e.g., 11 degrees) based on the incident angle dependency of the band-pass filter 60. Therefore, it is possible to reduce, as much as possible, chances that light rays with an undesired range of wavelength are included in light rays passing through the band-pass filter 60. In this regard, it is further preferable to dispose the light absorbing material, by coating or so forth, on the surface of the light shielding plate 120 in opposition to the light emitting diode 20. Additionally, in the present modification, as shown in FIG. 16, the light emitting diode 20 may be mounted to the one end 104 of the light shielding tube 100, and the band-pass filter 60 and the light shielding plate 120 may be mounted to the other end 106 of the light shielding tube 100. Unlike the modifications 10 and 11, limitations are not imposed on the setting of the upper limit for the diameter D of the other end 106 of the light shielding tube 100 in the present modification, whereby a sufficiently large value can be set for the diameter D. As described above, the light shielding plate 120 according to the present modification has a function to cut off light rays incident on the band-pass filter 60 at incident angles greater than the maximum incident angle, up to which the band-pass filter 60 is capable of exerting the light cutoff function.

(Modification 13)

Figure 17:
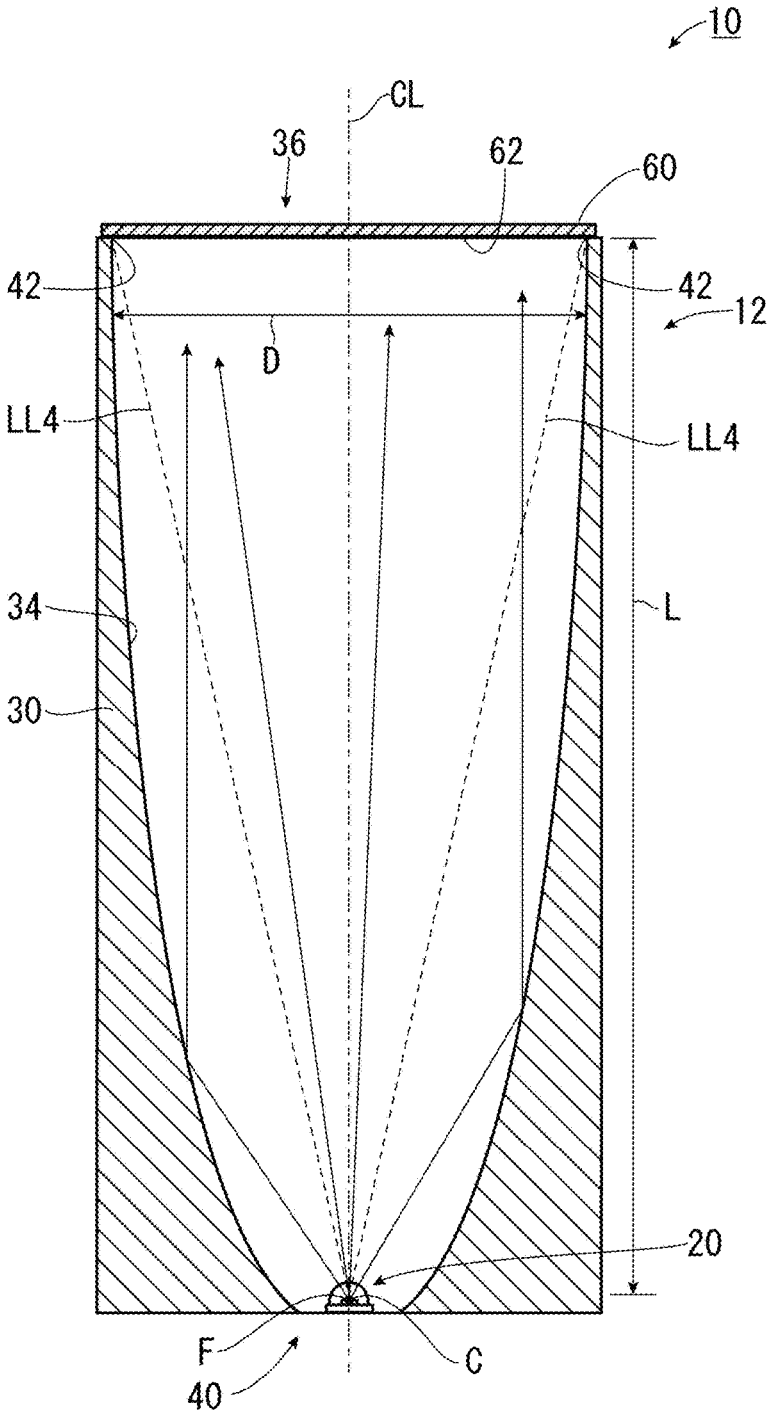
FIG. 17 is a cross-sectional view of the light emitting diode lamp 10 according to yet another modification.

Even when the reflector 30 is used as the light angle adjuster 12, as shown in FIG. 17, for instance, it is possible to easily output light rays with a circular cross section by using the reflector 30 including the reflective surface 34 defined by a complete paraboloid of revolution. In the present modification, the light emitting diode 20 is mounted to a bottom portion 40 of the reflective surface 34 of the reflector 30, whereas the band-pass filter 60 is mounted to the opening 36 of the reflector 30. Additionally, the length L of the reflective surface 34 (of the reflector 30) and the diameter D of the opening 36 are set such that on an imaginary cross section including the optical axis CL of the light emitting diode 20, an angle formed between the optical axis CL and an imaginary straight line LL4 is less than or equal to the maximum incident angle (of, e.g., 11 degrees) based on the incident angle dependency of the band-pass filter 60. The imaginary straight line LL4 herein connects the emission center C of the light emitting diode 20 and the edge of the other end (other end edge 42) of the reflective surface 34.

Moreover, the position of the reflector 30 and that of the light emitting diode 20 are adjusted to each other such that the position of the focal point F of the paraboloid of revolution defining the reflective surface 34 is matched with that of the emission center C of the light emitting diode 20.

Furthermore, the position of the light emitting diode 20 and that of the band-pass filter 60 are adjusted to each other such that the optical axis CL of the light emitting diode 20 is arranged orthogonally to the incident side plane 62 of the band-pass filter 60.

Accordingly, among light rays emitted from the light emitting diode 20, some directly pass through the band-pass filter 60 without striking the reflective surface 34 and exit to the outside when angles formed between those light rays and the optical axis CL are less than or equal to the maximum incident angle (of, e.g., 11 degrees) based on the incident angle dependency of the band-pass filter 60. By contrast, some are reflected by the reflective surface 34 and are then incident on the band-pass filter 60 at sufficiently small incident angles in the form of collimated light arranged in approximately parallel to the optical axis CL when angles formed between those light rays and the optical axis CL are greater than the maximum incident angle (of, e.g., 11 degrees) based on the incident angle dependency of the band-pass filter 60. The present modification is preferable in that approximately all light rays emitted from the light emitting diode 20, regardless of the angles formed between those light rays and the optical axis CL, pass through the band-pass filter 60 at angles of less than or equal to the maximum incident angle (of, e.g., 11 degrees) based on the incident angle dependency of the band-pass filter 60.

(Modification 14)

Figure 18:
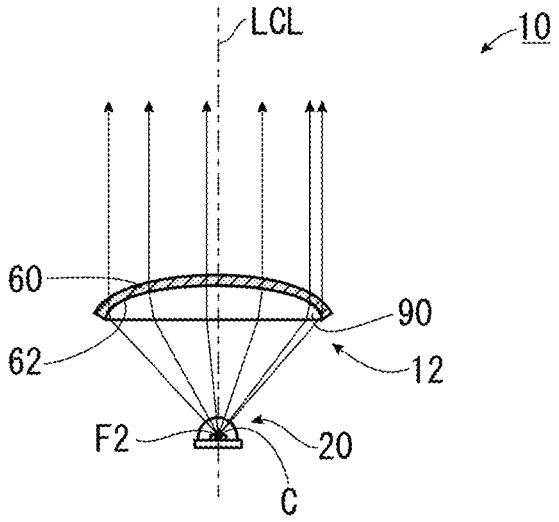
FIG. 18 is a cross-sectional view of the light emitting diode lamp 10 according to yet another modification.

Furthermore, as shown in FIG. 18, the band-pass filter 60 may be mounted along the light emission surface of the lens 90 (i.e., a surface located on the opposite side of a surface facing the light emitting diode 20).

Although the invention has been described in its preferred form with a certain degree of particularity, it is understood that the present disclosure of the preferred form has been changed in the details of construction and the combination and arrangement of parts may be resorted to without departing from the spirit and scope of the invention as hereinafter claimed.

The disclosure of Japanese patent Applications No. 2017-126851 filed on Jun. 29, 2017 and No. 2017-133172 filed on Jul. 6, 2017 including specifications, drawings and claims are incorporated herein by reference in its entirely.

What is claimed is:

1. A light emitting diode lamp comprising:

a light emitting diode;

a band-pass filter having a light cutoff function to cut off a light ray with a specific wavelength included in light rays emitted from the light emitting diode; and a light angle adjuster allowing the light rays emitted from the light emitting diode to be incident on the band-pass filter at angles of less than or equal to a maximum incident angle up to which the band-pass filter is capable of exerting the light cutoff function, wherein, the light angle adjuster is a reflector including a reflective surface defined by a paraboloid of revolution, the light emitting diode is mounted to a bottom portion of the reflective surface, the band-pass filter is mounted to an opening of the reflective surface, and wherein an optical axis of the light emitting diode and a straight line connecting an emission center of the light emitting diode and an edge of an opening of the reflective surface form an angle that is less than or equal to the maximum incident angle.

2. A light emitting diode lamp comprising:

a light emitting diode;

a band-pass filter having a light cutoff function to cut off a light ray with a specific wavelength included in light rays emitted from the light emitting diode; and a light shield blocking one or more of the light rays emitted from the light emitting diode when the one or more of the light rays are incident on the band-pass filter at one or more incident angles of greater than a maximum incident angle up to which the band-pass filter is capable of exerting the light cutoff function, wherein the light shield is a shielding tube having a tubular shape, the light emitting diode is mounted to one end of the shielding tube while the band-pass filter is mounted to the other end of the shielding tube, and on an imaginary cross section including an optical axis of the light emitting diode, an angle of less than or equal to the maximum incident angle is formed between the optical axis and an imaginary straight line connecting a light emission center of the light emitting diode and an edge of the other end of the shielding tube.

3. A light emitting diode lamp comprising:

a light emitting diode;

a band-pass filter having a light cutoff function to cut off a light ray with a specific wavelength included in light rays emitted from the light emitting diode;

a light shield blocking at least part of one or more of the light rays emitted from the light emitting diode when the one or more of the light rays are incident on the band-pass filter at one or more incident angles of greater than a maximum incident angle up to which the band pass filter is capable of exerting the light cutoff function; and a light angle adjuster allowing the unblocked rest of the one or more of the light rays to be incident on the band-pass filter at one or more incident angles of less than or equal to the maximum incident angle, wherein the light shield is a shielding tube having a tubular shape, the light angle adjuster is a lens, the light emitting diode is mounted to one end of the shielding tube while the band pass filter is mounted to the other end of the shielding tube, and the lens is mounted to an internal space of the shielding tube.

4. A light emitting diode lamp comprising:

a light emitting diode which emits infrared light rays;

a reflector including a reflective surface and an opening, the reflective surface being defined by a paraboloid of revolution including a cutout portion, the opening outwardly radiating light rays emitted from the light emitting diode therethrough after the light rays are reflected by the reflective surface;

a heat sink holding the light emitting diode such that a position of a light emission center of the light emitting diode is matched with a position of a focal point of the paraboloid of revolution, the heat sink being combined with the reflector so as to include the cutout portion of the paraboloid of revolution defining the reflective surface;

a band-pass filter covering the opening of the reflector, the band-pass filter including an incident side plane arranged orthogonally to a rotational axis of the paraboloid of revolution and the band-pass filter has a function to cut off visible light rays from the light emitting diode; and a light shielding member preventing the light emitting diode from being directly seen in a view from the opening side of the reflector at an angle parallel to the rotational axis of the paraboloid of revolution.

5. The light emitting diode lamp according to claim 4, wherein the light shielding member is shaped to block one or more of the light rays emitted from the light emitting diode when the one or more of the light rays exit from the opening without being reflected by the reflective surface.

6. The light emitting diode lamp according to claim 4, wherein the light shielding member is a portion of the heat sink, the portion being located closer to the opening than the light emitting diode.

7. The light emitting diode lamp according to claim 4, wherein the light shielding member is provided with a light absorbing layer disposed on a surface of a portion thereof illuminated by the light rays emitted from the light emitting diode.

* * * * *